US010099360B2

(12) United States Patent
Meixner et al.

(10) Patent No.: US 10,099,360 B2
(45) Date of Patent: Oct. 16, 2018

(54) TOOL SOCKET

(71) Applicant: Hilti Aktiengesellschaft, Schaan (LI)

(72) Inventors: Ralf Meixner, Germaringen (DE); Udo Hauptmann, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 10 days.

(21) Appl. No.: 15/120,282

(22) PCT Filed: Feb. 10, 2015

(86) PCT No.: PCT/EP2015/052736
§ 371 (c)(1),
(2) Date: Aug. 19, 2016

(87) PCT Pub. No.: WO2015/124460
PCT Pub. Date: Aug. 27, 2015

(65) Prior Publication Data

US 2017/0057073 A1 Mar. 2, 2017

(30) Foreign Application Priority Data

Feb. 20, 2014 (EP) ..... 14155930

(51) Int. Cl.
*B25D 17/08* (2006.01)
*B25D 17/00* (2006.01)

(52) U.S. Cl.
CPC .... *B25D 17/088* (2013.01); *B25D 2217/0069* (2013.01)

(58) Field of Classification Search
CPC ..... B25D 17/088; B25D 2217/0069
See application file for complete search history.

(56) References Cited

U.S. PATENT DOCUMENTS

| | | | |
|---|---|---|---|
| 6,923,271 | B2 | 8/2005 | Frauhammer et al. |
| 8,459,658 | B2 | 6/2013 | Cycon |
| 2003/0136586 | A1 | 7/2003 | Schneider et al. |
| 2011/0298187 | A1 | 12/2011 | Ontl et al. |
| 2014/0014383 | A1 | 1/2014 | Wiedner et al. |

FOREIGN PATENT DOCUMENTS

| | | |
|---|---|---|
| CN | 101439512 | 5/2009 |
| CN | 103538032 | 1/2014 |
| DE | 3606331 | 9/1987 |
| DE | 9305463 | 6/1993 |
| DE | 10157831 | 6/2003 |
| DE | 102010029609 | 12/2011 |

*Primary Examiner* — Daniel Howell
*Assistant Examiner* — Paul M Janeski
(74) *Attorney, Agent, or Firm* — Davidson, Davidson & Kappel, LLC

(57) ABSTRACT

A tool socket 2 for a hand-held power tool has a tubular main body 17 and a dust cap 27. The main body 17 has an end face 19 that is adjoined by a cylindrical or prismatic outer surface 36. As seen in the insertion direction 20, the dust cap 27 consecutively has a sealing ring 28, a middle section 29 and a seat 30. As seen in the insertion direction 20, the sealing ring 28 is arranged in front of the end face 19 of the main body 17. The seat 30 has a cylindrical or prismatic inner surface 35 that is in contact with the outer surface 36 of the main body 17. The middle section 29 has a conical inner surface 39 whose inner diameter 40 decreases in the insertion direction 20 down to the inner diameter 37 of the seat 30.

10 Claims, 2 Drawing Sheets

TOOL SOCKET

The present invention relates to a tool socket for a hand-held power tool, especially for a rotating and chiseling power tool, for example, a hammer drill such as that known from German patent application DE 10 2010 029609 A1.

SUMMARY OF THE INVENTION

The tool socket according to the invention for a hand-held power tool has a tubular main body and a dust cap. The main body has an end face that is adjoined by a cylindrical or prismatic outer surface. As seen in the insertion direction, the dust cap consecutively has a sealing ring, a middle section and a seat. As seen in the insertion direction, the sealing ring is arranged in front of the end face of the main body. The seat has a cylindrical or prismatic inner surface that is in contact with the outer surface of the main body. The middle section has a conical inner surface whose inner diameter decreases in the insertion direction down to the inner diameter of the cylindrical inner surface.

The seat of the dust cap fits tightly onto the main body. The inner surface of the seat and the outer surface of the main body are preferably complementary to each other. In contrast, the middle section is not in contact with the main body. The middle section forms a flexure hinge that allows a small deflection of the sealing ring crosswise to the working axis. In this manner, the sealing ring can follow crosswise movements of the drill or chisel. The sealing ring remains in contact around the drill bit and seals the opening of the tool socket. Moreover, this reduces abrasion of the sealing ring caused by wobbling drill bits.

BRIEF DESCRIPTION OF THE DRAWINGS

The description below explains the invention on the basis of embodiments and figures given by way of example. The figures show the following.

Unless otherwise indicated, identical or functionally equivalent elements are designated in the figures by the same reference numerals.

DETAILED DESCRIPTION

Figure 1:
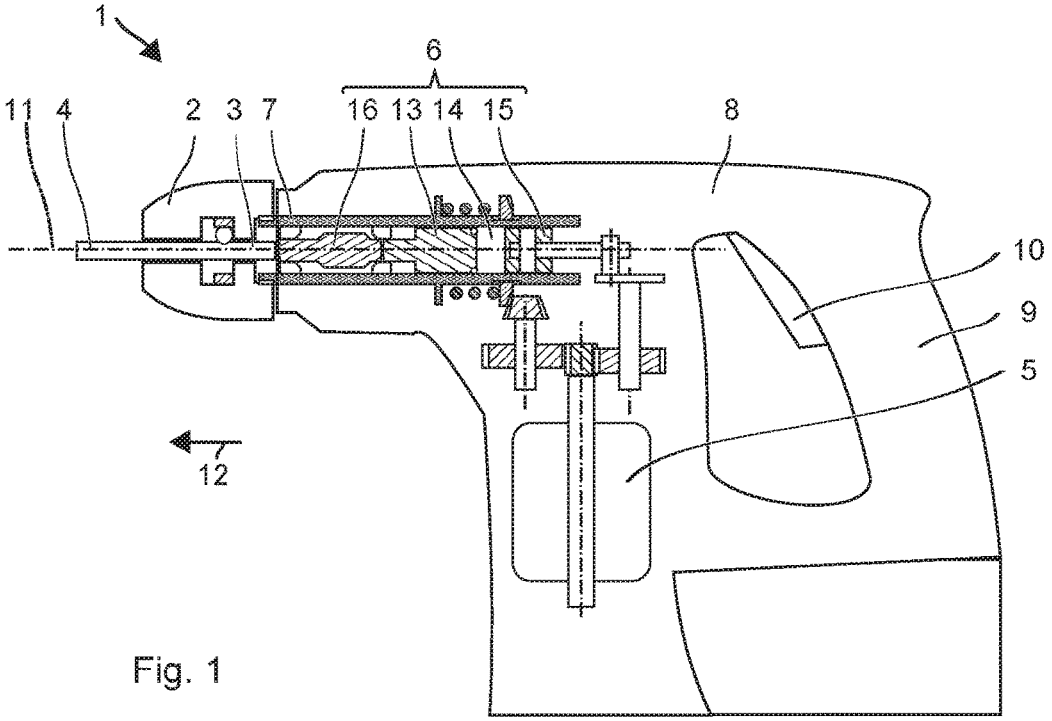
FIG. 1 a hammer drill.

FIG. 1 schematically shows a combination hammer drill 1 as an example of a handheld chiseling power tool. The combination hammer drill 1 has a tool socket 2 into which one shank end 3 of a tool, for example, a drill bit 4, can be inserted. The primary drive of the combination hammer drill 1 is in the form of a motor 5 which drives a striking mechanism 6 as well as a driven shaft 7. The motor 5 and the striking mechanism 6 are arranged in a machine housing 8. A user can guide the combination hammer drill 1 by means of a handle 9 that is attached to the machine housing 8 and can start up the combination hammer drill 1 by means of a system switch 10. During operation, the combination hammer drill 1 continuously rotates the drill bit 4 around the working axis 11 and, in this process, it can hammer the drill bit 4 into a substrate in the striking direction 12 along the working axis 11. The striking mechanism 6 is preferably a motor-driven pneumatic striking mechanism 6. A striker 13 is coupled via a pneumatic spring 14 to a piston 15 that is moved back and forth along a working axis 11 by the motor 5. The striker 13 strikes the shank end 3 either directly or else indirectly via a striking pin 16.

Figure 2:
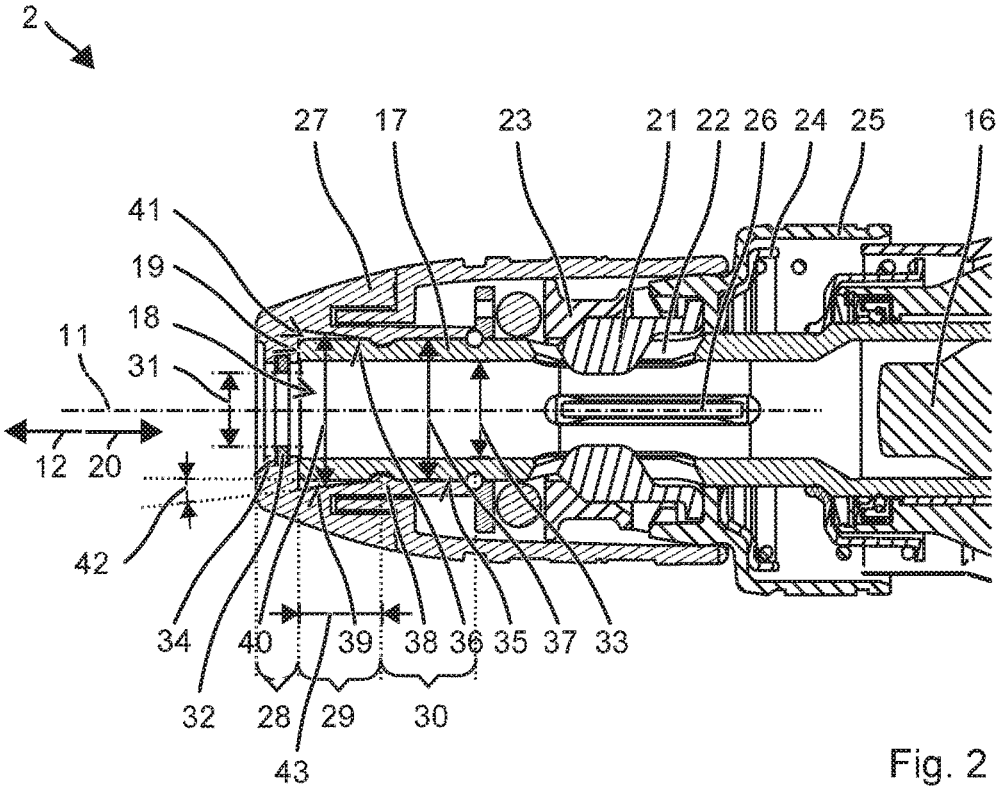
FIG. 2 a tool socket.

The tool socket 2 is shown in detail in a longitudinal sectional view in FIG. 2. The tool socket 2 has a hollow spindle 17 (main body) that is driven by the driven shaft 7 and that has a chamber 18 for the drill bit 4. The drill bit 4 can be inserted into the chamber 18 through an opening located on the driven side on the end face 19 of the main body 17 in the insertion direction 20 (counter to the striking direction 12). The chamber 18 is preferably configured to be complementary to the shank end 3, for example, cylindrically. By way of example, the tool socket 2 has two catches 21 that extend partially into the chamber 18. The catches 21 are situated in two slots 22 that have been made in the main body 17. A locking ring 23 covers the two catches 21 in the radial direction in such a way that they cannot deflect radially. A slide 24 that is spring-loaded counter to the insertion direction 20 holds the two catches 21 in the locking ring 23. By means of an unlocking sleeve 25, a user can pull the two catches 21 out of the locking ring 23 in the insertion direction 20, so that they can pivot radially out of the chamber 18. Instead of catches 21, it is also possible to use balls.

The tool socket 2 also has one or more webs 26 that extend into the chamber 18 and that are rigidly connected to the main body 17. A rotating movement of the main body 17 around the working axis 11 is transmitted to the drill bit 4 via the webs 26.

A dust cap 27 protects the tool socket 2 against dust. The dust cap 27 is slipped onto the main body 17 in the insertion direction 20. The dust cap 27 has three immediately consecutive sections 28, 29, 30 in the insertion direction 20 of the drill bit 4. The three sections 28, 29, 30 preferably form a monolithic component, that is to say, they are contiguous without joining zones, being neither glued, welded or screwed together, etc.

The frontmost section 28 forms a sealing ring 28. The sealing ring 28 is in front of the main body 17 as seen in the insertion direction 20. The inner diameter 31 of the sealing ring 28 is smaller than the typical diameter of the drill bit 4, and correspondingly, the inner diameter 31 of the sealing ring 28 is smaller than the inner diameter 33 of the chamber 18. The sealing ring 28 and the drill bit 4 are firmly joined to each other so as to be dust-tight, thereby preventing dust from getting into the chamber 18. The sealing ring 28 can have a sealing lip 32 that is placed into the inner surface 34 of the sealing ring 28 and that defines its inner diameter 31. The sealing lip 32 is a thin ring that is preferably made of a softer plastic than that of the dust cap 27, for example, it is made of rubber.

A rear section 30 of the dust cap 27 forms a seat 30 of the dust cap 27 with a cylindrical inner surface 35. The inner surface 35 is preferably tightly in contact with the outer surface 36 of the main body 17. The inner surface 35 of the seat 30 preferably has the same shape as the outer surface 36 of the main body 17, that is to say, both are cylindrical or both are prismatic. The inner diameter 37 of the seat 30 is equal to the outer diameter of the main body 17. An annular thickening 38 of the seat 30 can engage into an annular groove of the main body 17 in order to prevent the dust cap 27 from being accidentally pulled off.

A middle section 29 connects the front section 28 and the rear section 30. The middle section 29 forms a flexure hinge 29 between the sealing ring 28 and the seat 30. The middle section 29 has a conical inner surface 39. The conical inner surface 39 widens increasingly from the seat 39 to the sealing ring 28, at least all the way to the end face 19 of the main body 17. Correspondingly, the inner diameter 40 increases counter to the insertion direction 20. There is a wedge-shaped gap 41 between the middle section 29 and the main body 17. The inclination 42 of the conical inner surface 39 is small and falls within the range between 5° and 20°. A length 43 of the middle section 29 is greater than half of the inner diameter 37 of the seat 30, that is to say, greater than half of the outer diameter of the main body 17.

What is claimed is:

1. A tool socket for a hand-held power tool, the tool socket comprising:

a tubular main body having, coaxially to a working axis, a cylindrical or prismatic chamber, a tool insertable in an insertion direction into the chamber, the tubular main body having a cylindrical or prismatic outer surface adjoined by an end face, and with respect to the insertion direction, a dust cap, the dust cap having consecutively a sealing ring, a middle section and a seat, and with respect to the insertion direction, the sealing ring being arranged in front of the end face of the main body, the middle section being arranged so as to surround the main body, the seat having a cylindrical or prismatic inner surface and being arranged so as to be in contact with the outer surface of the main body, the middle section having a conical inner surface whose inner diameter decreases in the insertion direction down to an inner diameter of the seat, wherein a wedge-shaped gap exists between the middle section and the main body, the middle section forming a flexure hinge.

2. The tool socket as recited in claim 1 wherein an inclination of the conical inner surface relative to the working axis is between 5° and 20°.

3. The tool socket as recited in claim 1 wherein a dimension of the conical inner surface along the working axis is greater than half of the inner diameter.

4. The tool socket as recited in claim 1 wherein an inner diameter of the sealing ring is smaller than an inner diameter of the main body.

5. The tool socket as recited in claim 4 wherein the sealing ring has an inserted sealing lip whose plastic is softer than that of the dust cap.

6. The tool socket as recited in claim 1 wherein the tubular main body has the prismatic chamber and the seat has the prismatic inner surface.

7. The tool socket as recited in claim 1 wherein the tubular main body has the cylindrical chamber and the seat has the cylindrical inner surface.

8. The tool socket as recited in claim 1 wherein the sealing ring, the middle section and the seat form a monolithic component.

9. The tool socket as recited in claim 1 wherein the flexure hinge allows deflection of the sealing ring crosswise to the working axis.

10. The tool socket as recited in claim 1 wherein the seat has an annular thickening.

* * * * *